United States Patent [19]

Shikutani et al.

[11] 4,269,571

[45] May 26, 1981

[54] BLOWING APPARATUS

[75] Inventors: Michio Shikutani; Satoshi Akiyama, both of Odawara, Japan

[73] Assignee: Kabushiki Kaisha Shikutani, Japan

[21] Appl. No.: 66,778

[22] Filed: Aug. 14, 1979

[51] Int. Cl.[3] ..... F04B 39/12; F04D 29/44

[52] U.S. Cl. ..... 417/234; 415/210; 415/219 C

[58] Field of Search ..... 417/234, 364, 371, 423 R; 415/210, 219 C

[56] References Cited

U.S. PATENT DOCUMENTS

| | | | |
|---|---|---|---|
| 1,061,205 | 5/1913 | Spencer | 415/219 C |
| 1,375,595 | 4/1921 | Lamontagne | 417/423 R |
| 1,733,499 | 10/1929 | Klemm | 417/423 R |
| 2,142,307 | 1/1939 | Mey et al. | 415/210 |
| 4,132,507 | 1/1979 | Akiyama et al. | 417/234 |

*Primary Examiner*—Leonard E. Smith

*Attorney, Agent, or Firm*—Birch, Stewart, Kolasch & Birch

[57] ABSTRACT

Blowing apparatus suspensible from one's shoulder is provided with a centrifugal fan, in which air is axially sucked and blown off. The fan has a rotor coupled with the output shaft of a prime mover and a casing common to the housing of the apparatus. The housing consists of front, mid and rear coverings, the rear covering being connected with the mid covering to surround the prime mover. The front covering is interiorly formed with fixed vanes similar to the rotary vanes on the rotor. The mid covering has radial stays supporting a central ring to which the casing of the prime mover is removably secured. The front covering is air-tightly connected to the mid covering to define an annular space, an axial entrance and an axial exit with the conical and cylindrical walls of the mid covering. The rotor is disposed and rotated in the space, in which air is centrifugally compressed along the rotary vanes in the rear side of the rotor to peripherally transfer to the front side. Then, compressed air is centripetally guided along the fixed vanes to flow through the exit toward an axial nozzle.

7 Claims, 4 Drawing Figures

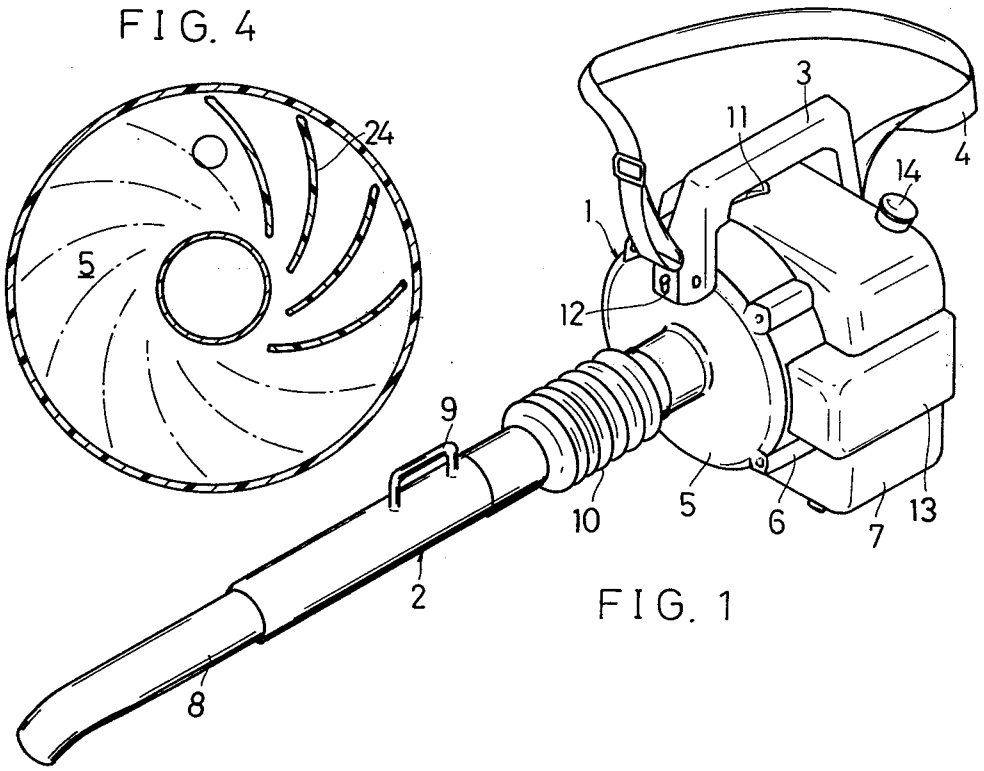
FIG. 1
FIG. 4
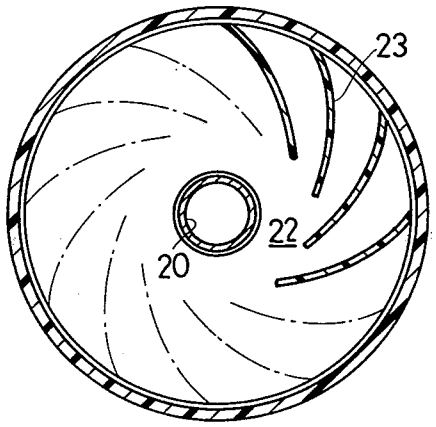
FIG. 3

BLOWING APPARATUS

BACKGROUND AND SUMMARY OF THE INVENTION

The present invention relates to blowing apparatus of the type having a centrifugal fan driven by a gasoline engine or electric motor and more particularly to a light and compact body suspensible from one's shoulder both for use and conveyance.

High-pressure blowers are known that are provided with a centrifugal fan and carried on one's back. Such blowers are usually equipped with an exchangeable one-sided, generally right-handed blowing nozzle and therefore are awkward to do tasks on the left. It is often the case that a blowing operation accompanies another work, such as water-sprinkling, repairing gutters and downspouts, and carrying garbage cans, it is troublesome to load and unload the blower onto and from the operator's back whenever the type of work changes.

In accordance with the invention, the apparatus has interiorly a prime mover and a centrifugal fan and exteriorly a housing and a blowing nozzle centrally joined to the housing. The fan has a rotor provided with a plurality of curved vanes and a casing common to the housing. The housing consists of front, mid and rear coverings, the rear covering being peripherally joined to the mid covering. The mid covering is composed of an outer cylindrical wall, an inner conical wall peripherally fixed to the cylindrical wall, a plurality of cross-sectionally streamline stays inwardly radially extending from the cylindrical wall behind the conical wall, and a central ring supported by the stays. The prime mover has its casing removably secured to the central ring and the output shaft directly coupled with the rotor. The front covering is interiorly formed with fixed vanes similar in number and shape to the rotary vanes on the rotor and air-tightly connected to the mid covering to define an annular space together with the cylindrical and conical walls. The space has as an axial entrance an annular gap defined by the inner periphery of the conical wall and as an axial exit the central bore in the front covering. The rotor is disposed in the space to have a predetermined clearance between the fixed vanes and the conical and cylindrical walls. The blowing nozzle and the front and rear coverings are made of synthetic plastics and the mid covering and the rotor are made of light metal or synthetic plastics.

A handle and a shoulder belt are attached to the housing. Spongy pads are affixed on the both sides of the housing so as to prevent uncomfortable vibrations from being transmitted to one who operates it. A pair of feet are mounted on the underside of the housing and occasionally wheeled for convenience. The apparatus is simple in construction, compact and light enough to be suspended from one's shoulder by a shoulder belt or carried in a hand by a handle in a substantially horizontal position. Upon rotation of the rotor, air is sucked from the back side of the apparatus to flow around the prime mover. The air is straightened by the streamline stays prior to entering the space through the axial entrance. The air in the rear side of the space is centrifugally compressed along the rotary vanes to peripherally shift to the front side of the space. Then, the compressed air is centripetally guided along the fixed vanes to flow toward the blowing nozzle through the axial exit.

In summary, it is the primary object of the present invention to provide a suspensible blowing apparatus of the type having a relatively high-pressure centrifugal fan.

Other objects, features and advantages of the invention will appear more fully from the detailed description given hereinafter.

BRIEF DESCRIPTION OF THE DRAWINGS

The invention will become more fully understood from the detailed description given hereinbelow and the accompanying drawings which are given by way of illustration only, and thus are not limitative of the present invention, and wherein:

FIG. 1 is a perspective view of an embodiment of the apparatus according to the present invention;

FIGS. 3 and 4 are sectional views taken along the lines III—III and IV—IV in FIG. 2.

DETAILED DESCRIPTION OF THE PREFERRED EMBODIMENT

Figure 2:
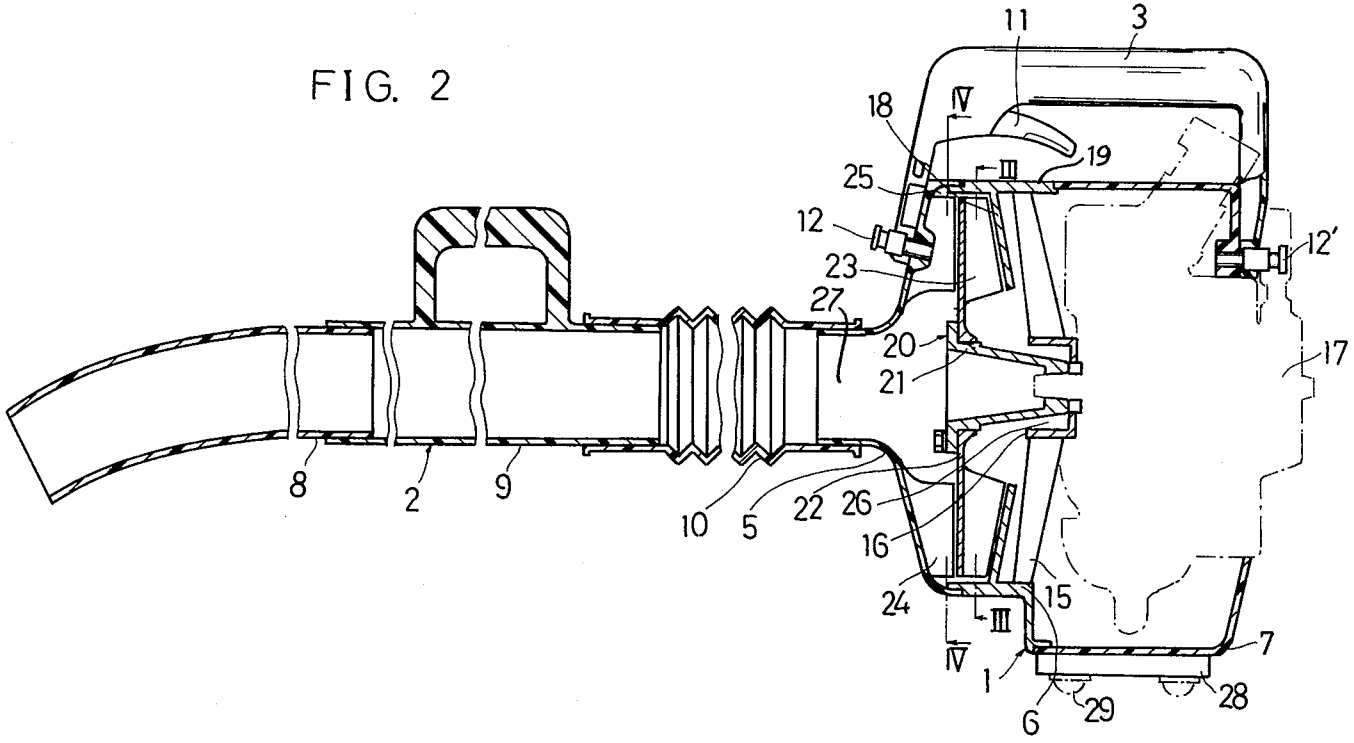
FIG. 2 is a longitudinal sectional view of the apparatus of FIG. 1.

As is shown in FIG. 1, the portable type blower of the invention includes in appearance a housing 1, a blowing pipe 2, a handle 3 and a shoulder belt 4. The housing 1 is composed of a front funnel-shaped covering 5 of synthetic plastics, a mid cylindrical covering 6 of light metal, and a rear square-built covering 7 of synthetic plastics. The blowing pipe 2 extends axially centrally from the front side of the housing 1 and consists of an end nozzle 8, a handled tube 9 and a flexible tube 10, each being made of synthetic plastics. The handle 3 of synthetic plastics is provided with a throttle lever 11 and secured to the front and rear coverings 5, 7. The belt hooks 12 are fixed to the top of housing 1 in a manner that the belt 4 hangs the blower in a substantially horizontal position. Both side pads 13 of spongy material are mounted on the opposite sides of the housing 1. An inlet port 14 for a non-illustrated fuel tank projects from the top of the rear covering 7.

As is shown in FIG. 2, the mid covering 6 is integrally formed with a plurality of radial stays 15 inwardly extending from an outer cylindrical wall 19 to support a central ring 16. The mid covering 6 is provided with an inner conical wall 18 peripherally fixed to the cylindrical wall 19 in front of the stays 16. The rear covering 7 is peripherally connected with the mid covering 6 to surround an outlined gasoline engine 17 except its back side and inlet port 14. The engine 17 has its casing removably secured to the ring 16 and the crank shaft directly coupled with the cup-shaped hub 21 of a rotor 20 of light metal.

The rotor 20 has a rotary disk 22 peripherally fixed to the hub 21, the disk 22 being integrally formed with twelve curved vanes 23. The front covering 5 is interiorly formed with twelve fixed vanes 24 similar in shape to the rotary vanes 23. The front casing 5 is air-tightly connected with the mid covering 6 to define an annular space 25 together with the conical and cylindrical walls 18, 19, the space 25 having as an axial entrance 26 an annular gap defined by the inner periphery of the conical wall 18 and as an axial exit 27 the central bore formed in the front covering 5. The rotor 20 is so disposed in the space 25 as to have a predetermined clearance among the fixed vanes 24, the conical wall 18 and the cylindrical wall 19. An electric motor can take the place of the gasoline engine 17. The radial stays 15 and the conical wall 18 may be joined together.

The flexible tube 10 has one end thereof coupled with the central bore portion or exit 27 and the other end connected with the handled tube 9. The end nozzle 8 is endwise inserted into the handled tube 9. The opposite belt hooks 12, 12' are threaded to the front and rear coverings 5, 7 through the handle 3. The lever 11 is so attached to the handle to be operated by one or two fingers of a hand gripping the handle. The housing 1 has a pair of feet 28 fixed to the underside thereof and occasionally casters 29 provided on each foot 28, as is shown by dotted lines.

As are seen in FIGS. 3 and 4, the fixed vanes 24 on the front covering 5 are of the same number and cross-sectional shape as the vanes 23 on the rotary disk 22 with the result that a pressure-drop of air is minimized when air turns from the centrifugal flowing to the centripetal one.

The manner of operation of the blower will now be explained. Firstly, fuel is poured into the tank through the inlet port 14. An operator wears the belt 4 on his shoulder and grips the handle 3 by one of his hands to trigger the lever 11. As the rotor 20 rotates, air is sucked from the back side to flow around the engine 17. The engine may have no cooling impellers because it is cooled by the suction-air flowing around it. The air is rectified along the streamline stays 15 to enter the space 25 through the axial entrance 26. In the rear side of the space 25 or the rotary disk 22, the air is compressed under a centrifugal action of the rotary vanes 23 to flow out of the top periphery of the disk 22 to the front side of the space 25. Thus highly compressed air is centripetally guided along the fixed vanes 24 without suffering a substantial loss of pressure in the front side of the space 25 or the rotary disk 22, then flowing toward the blowing pipe 2 through the axial exit 27. The nozzle 8 blows a jet of high-pressure air strong enough to clean away dead leaves, greens and debris from street and gardens as well as to blast off accumulated soil and singles from roofs. The operator can firmly hold the housing 1 of the blower with the pad 13 against his body and freely operate the handled tube 9 with his hand to perform blowing works. The spongy pad 13 absorbs uncomfortable vibrations to prevent its transmission to the operator. In the case of the blower provided with caster 29, it will be dragged to roll both for use and for conveyance. The operator can easily position and disengage the blower from either his right and left shoulder in accordance with various working conditions. The operator can remove the blower from his shoulder and set it aside with little effort whenever he desires to use another tool for doing different tasks such as repairing gutters and downspouts and water sprinkling.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A blowing apparatus comprising a prime mover, a centrifugal fan having the rotor thereof coupled with a rotating shaft of the prime mover, a housing composed of front, mid and rear coverings, a blowing nozzle axially connected to the center of the front covering, a shoulder belt attached to the housing, the mid covering consisting of an outer cylindrical wall, an inner conical wall peripherally joined to the cylindrical wall, a plurality of radial stays inwardly extending from the cylindrical wall behind the conical wall, and a central ring peripherally joined to the inner ends of the radial stays, the prime mover having the casing thereof removably secured to the central ring, the rotor having a plurality of curved vanes provided thereon, the front covering being interiorly formed with a plurality of fixed vanes similar in number and shape to the vanes on the rotor, the rear covering being connected to the mid covering to surround the prime mover except the back side thereof, the front covering being air-tightly connected to the mid covering to define an annular space together with the conical and cylindrical walls, the space having an axial entrance defined by the inner periphery of the conical wall and an axial exit formed in the front covering, the rotor being so disposed in the space as to have a predetermined clearance among the fixed vanes, the conical wall and the cylindrical wall.

2. A blowing apparatus according to claim 1, wherein the radial stay is cross-sectionally streamline.

3. A blowing apparatus according to claim 2, wherein the radial stay is joined to the conical wall.

4. A blowing apparatus according to claim 1, wherein the rotor consists of a cup-shaped hub coupled with the rotating shaft of the prime mover and a rotary disk peripherally fixed to the hub and formed with the fixed vanes.

5. A blowing apparatus according to claim 1, wherein the housing has a pair of pads of spongy material mounted on the both sides thereof.

6. A blowing apparatus according to claim 1, wherein the housing is wheeled.

7. A blowing apparatus according to claim 1, wherein the housing has a handle fixed thereto, the handle being provided with a switch for operation of the prime mover.

* * * * *